US010604915B2

(12) United States Patent
Joo

(10) Patent No.: US 10,604,915 B2
(45) Date of Patent: Mar. 31, 2020

(54) HYDRAULIC SYSTEM AND HYDRAULIC CONTROL METHOD FOR CONSTRUCTION MACHINE

(71) Applicant: DOOSAN INFRACORE CO., LTD., Incheon (KR)

(72) Inventor: Choon-shik Joo, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 12 days.

(21) Appl. No.: 15/781,434

(22) PCT Filed: Jun. 1, 2016

(86) PCT No.: PCT/KR2016/005796
§ 371 (c)(1),
(2) Date: Jun. 4, 2018

(87) PCT Pub. No.: WO2017/094986
PCT Pub. Date: Jun. 8, 2017

(65) Prior Publication Data

US 2018/0355584 A1 Dec. 13, 2018

(30) Foreign Application Priority Data

Dec. 4, 2015 (KR) ..... 10-2015-0172666

(51) Int. Cl.
*E02F 9/22* (2006.01)
*F02D 29/04* (2006.01)

(52) U.S. Cl.
CPC ..... *E02F 9/2267* (2013.01); *E02F 9/2217* (2013.01); *E02F 9/2246* (2013.01);
(Continued)

(58) Field of Classification Search
CPC ..... F15B 2211/88; F15B 21/14; E02F 9/2217
See application file for complete search history.

(56) References Cited

U.S. PATENT DOCUMENTS 7,634,911 B2 * 12/2009 Brinkman ..... E02F 9/2075 60/414
9,086,061 B2 * 7/2015 Zhang ..... F04B 49/002
(Continued)

FOREIGN PATENT DOCUMENTS

KR 10-2012-0080645 A 7/2012
KR 10-2014-0103989 A 8/2014
(Continued)

OTHER PUBLICATIONS

International Search Report for Application No. PCT/KR2016/005796 dated Jun. 1, 2016 citing the above reference(s).

*Primary Examiner* — F Daniel Lopez
(74) *Attorney, Agent, or Firm* — Hauptman Ham, LLP

(57) ABSTRACT

A hydraulic system for construction machinery includes a boom cylinder, a main control valve including a boom control spool that is configured to selectively supply a hydraulic oil from a hydraulic pump to a boom head chamber and a boom rod chamber of the boom cylinder, a regeneration device connected to the boom head chamber of the boom cylinder through a hydraulic regeneration line, a regeneration valve unit installed in the regeneration line, and a control unit connected to the main control valve and the regeneration valve unit, wherein in a boom down low speed mode the hydraulic oil is drained through the regeneration device to lower the boom at a first speed, and in a boom down high speed mode the hydraulic oil is drained through the regeneration device and the main control valve to lower the boom at a second speed greater than the first speed.

9 Claims, 8 Drawing Sheets

(52) U.S. Cl.
CPC ..... *E02F 9/2292* (2013.01); *E02F 9/2296* (2013.01); *F02D 29/04* (2013.01); *F15B 2211/88* (2013.01)

(56) References Cited

U.S. PATENT DOCUMENTS

| | | | | |
|---|---|---|---|---|
| 10,161,108 | B2 * | 12/2018 | Hijikata | E02F 9/2075 |
| 2015/0007557 | A1 * | 1/2015 | Egawa | F15B 21/14 60/446 |

FOREIGN PATENT DOCUMENTS

| | | | |
|---|---|---|---|
| KR | 10-20140135690 | A | 11/2014 |
| KR | 10-2015-0110597 | A | 10/2015 |
| WO | 2014157902 | A1 | 10/2014 |

* cited by examiner

HYDRAULIC SYSTEM AND HYDRAULIC CONTROL METHOD FOR CONSTRUCTION MACHINE

CROSS REFERENCE TO RELATED APPLICATION

This present application is a national stage filing under 35 U.S.C § 371 of PCT application number PCT/KR2016/005796 filed on Jun. 1, 2016 which is based upon and claims the benefit of priority to Korean Patent Application No. 10-2015-0172666 filed on Dec. 4, 2015 in the Korean Intellectual Property Office. The disclosures of the above-listed applications are hereby incorporated by reference herein in their entirety.

TECHNICAL FIELD

The present invention relates to a hydraulic system and a hydraulic control method for construction machinery, more particularly, to a hydraulic system for controlling a boom cylinder that raises and lowers a boom of the construction machinery and a hydraulic control method.

BACKGROUND ART

Construction machinery may raise and lower a front work apparatus using a hydraulic cylinder to. For example, an engine power may be used to drive a hydraulic pump, and a hydraulic oil discharged from the hydraulic pump may be supplied to a boom cylinder through a main control valve to generate stoke of the boom cylinder, thereby raising a boom. On the other hand, when the boom is lowered, the hydraulic oil from the boom cylinder may be drained to a drain tank through the main control valve due to gravity of the front work apparatus. During the boom down operation, potential energy of the front work apparatus may not be effectively utilized. Accordingly, a new technique of regenerating the potential energy may have been developed.

DISCLOSURE OF THE INVENTION

Problems to be Solved

An object of the present invention provides a hydraulic system for construction machinery including a boom energy regeneration device capable of increasing work rate.

Another object of the present invention provides a hydraulic control method using the above hydraulic system for construction machinery.

Means to Solve the Problems

According to example embodiments, a hydraulic system for construction machinery includes a boom cylinder for operating a boom of the construction machinery, a main control valve including a boom control spool that is configured to selectively supply a hydraulic oil from a hydraulic pump to a boom head chamber and a boom rod chamber of the boom cylinder through a boom head hydraulic line and a boom rod hydraulic line, a regeneration device connected to the boom head chamber of the boom cylinder through a hydraulic regeneration line to regenerate energy of the boom cylinder, a regeneration valve unit installed in the regeneration line and including a discharge amount control valve that configured to control an amount of the hydraulic oil flowing through the hydraulic regeneration line, and a control unit connected to the main control valve and the regeneration valve unit and configured to control operations of the main control valve and the regeneration valve unit, wherein in a boom down low speed mode the hydraulic oil is drained through the regeneration device to lower the boom at a first speed, and in a boom down high speed mode the hydraulic oil is drained through the regeneration device and the main control valve to lower the boom at a second speed greater than the first speed.

In example embodiments, the control unit may include a control valve to apply a pilot signal pressure for opening and closing the discharge amount control valve.

In example embodiments, the control valve may include an electro proportional pressure reducing valve.

In example embodiments, the regeneration valve unit may further include a check valve installed in the hydraulic regeneration line in front of the discharge amount control valve.

In example embodiments, the regeneration valve unit may further include an opening/closing valve be installed in a connection line which connects the hydraulic regeneration line to the boom rod chamber, to selectively supply a portion of the hydraulic oil discharged through the hydraulic regeneration line to the boom rod chamber.

In example embodiments, the hydraulic system for construction machinery may further include a bypass valve provided between a manipulation portion for manipulating the boom and the main control valve to block a control pressure from the manipulation portion from being transferred to the main control valve.

In example embodiments, the control unit may control such that in the boom down low speed mode the discharge amount control valve is opened and a control pressure from a manipulation portion is blocked from being transferred to the boom control spool.

In example embodiments, the control unit may control such that in the boom down high speed mode the discharge amount control valve is opened and a control pressure from a manipulation portion is transferred to the boom control spool.

In example embodiments, the hydraulic oil from the boom head chamber may be drained to a drain tank through the boom head hydraulic line and the boom control spool.

In example embodiments, the regeneration device may include a hydraulic motor connected to the hydraulic regeneration line and the hydraulic motor may be connected to a drive axis of an engine to provide a rotational force to the hydraulic pump.

In example embodiments, the regeneration device may further include an accumulator connected to the hydraulic regeneration line. hydraulic motor In example embodiments, the hydraulic system for construction machinery may further include an opening/closing valve installed in the hydraulic regeneration line connected to the accumulator to selectively supply the hydraulic oil to the accumulator.

According to example embodiments, in a hydraulic control method for construction machinery, usage of a boom down high speed mode of a regeneration mode for regenerating boom energy of the construction machinery is determined. A hydraulic oil from a boom head chamber of the boom cylinder is drained through a regeneration device that is connected to the boom head chamber by a hydraulic regeneration line, to lower the boom at a first speed when the boom down high speed mode is not selected. The hydraulic oil from the boom head chamber is drained through the regeneration device and draining the hydraulic oil through a main control valve that is connected to the boom head chamber by a boom head hydraulic line, to lower the boom at a second speed greater than the first speed when the boom down high speed mode is selected.

In example embodiments, when the boom down low speed mode is selected a control pressure from a manipulation portion that manipulates the boom may be blocked from being transferred to a boom control spool of the main control valve.

In example embodiments, when the boom down high speed mode is selected a control pressure from a manipulation portion that manipulates the boom may be transferred to a boom control spool of the main control valve.

In example embodiments, draining the hydraulic oil through the regeneration device may include opening a discharge amount control valve that is installed in the hydraulic regeneration line.

In example embodiments, the regeneration device may include an accumulator and a hydraulic motor connected to the hydraulic regeneration line.

In example embodiments, in the boom down high speed mode the hydraulic oil may be blocked from being transferred to the accumulator.

In example embodiments, the hydraulic control method for construction machinery may further include closing the hydraulic regeneration line and transferring a control valve from a manipulation portion to a boom control spool of the main control valve when a boom down normal mode is selected.

Effects of the Invention

According to example embodiments, in a hydraulic system and a hydraulic control method for construction machinery, when a boom is lowered, boom energy may be recovered to reduce fuel consumption to thereby improve fuel efficiency. Further, as a boom descent speed is increased, a work rate may be increased to improve productivity. Especially, in a work (for example, a loading work) in which the construction machinery performs a boom up operation and a boom down operation repeatedly, productivity may be maximized.

However, the effect of the invention may not be limited thereto, and may be expanded without being deviated from the concept and the scope of the present invention.

BEST MODE FOR CARRYING OUT THE INVENTION

Figure 1:
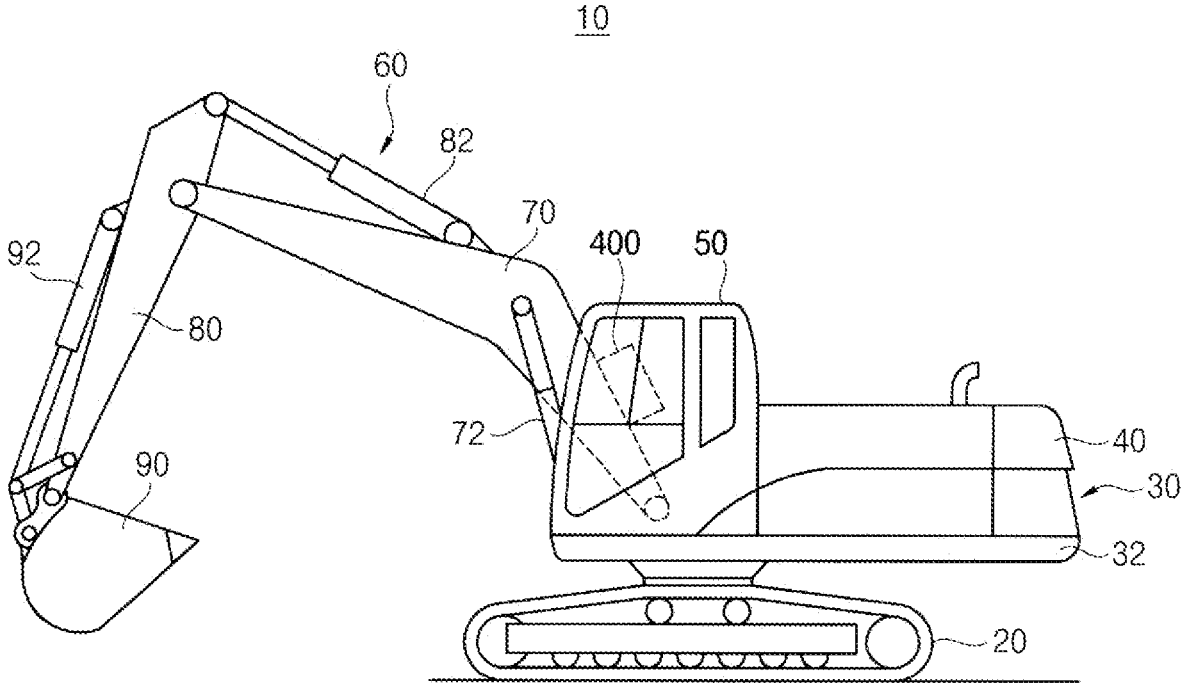
FIG. 1 is a view illustrating a selective catalytic reduction system in accordance with example embodiments.

Various example embodiments will be described more fully hereinafter with reference to the accompanying drawings, in which example embodiments are shown. Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art. In the drawings, the sizes and relative sizes of components or elements may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element or layer is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, preferable embodiments of the present invention will be explained in detail with reference to the accompanying drawings. Like numerals refer to like elements throughout example embodiments, and any further repetitive explanation concerning the similar elements will be omitted.

Figure 2:
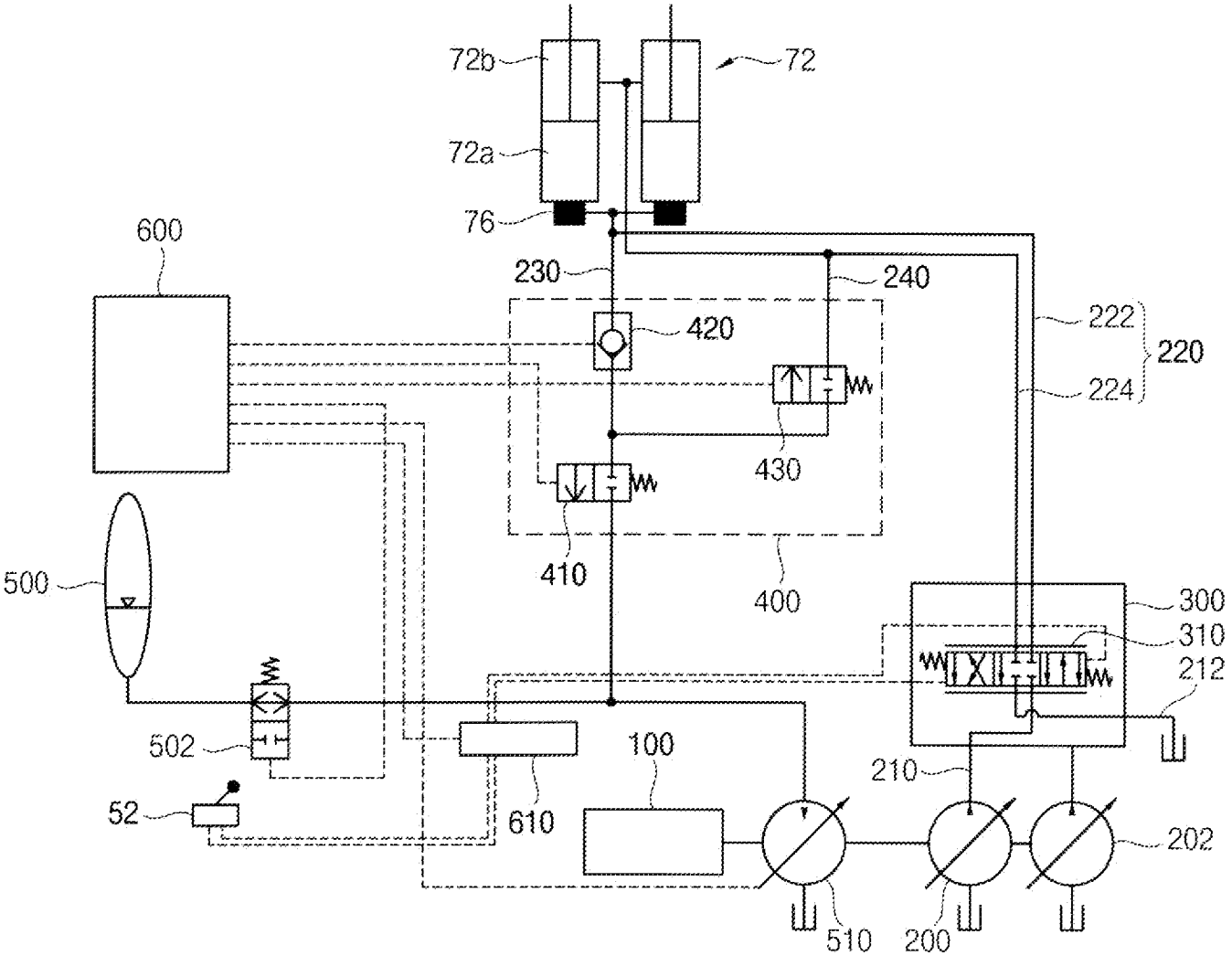
FIG. 2 is a hydraulic circuit diagram illustrating a hydraulic system for construction machinery in accordance with example embodiments.
Figure 3:
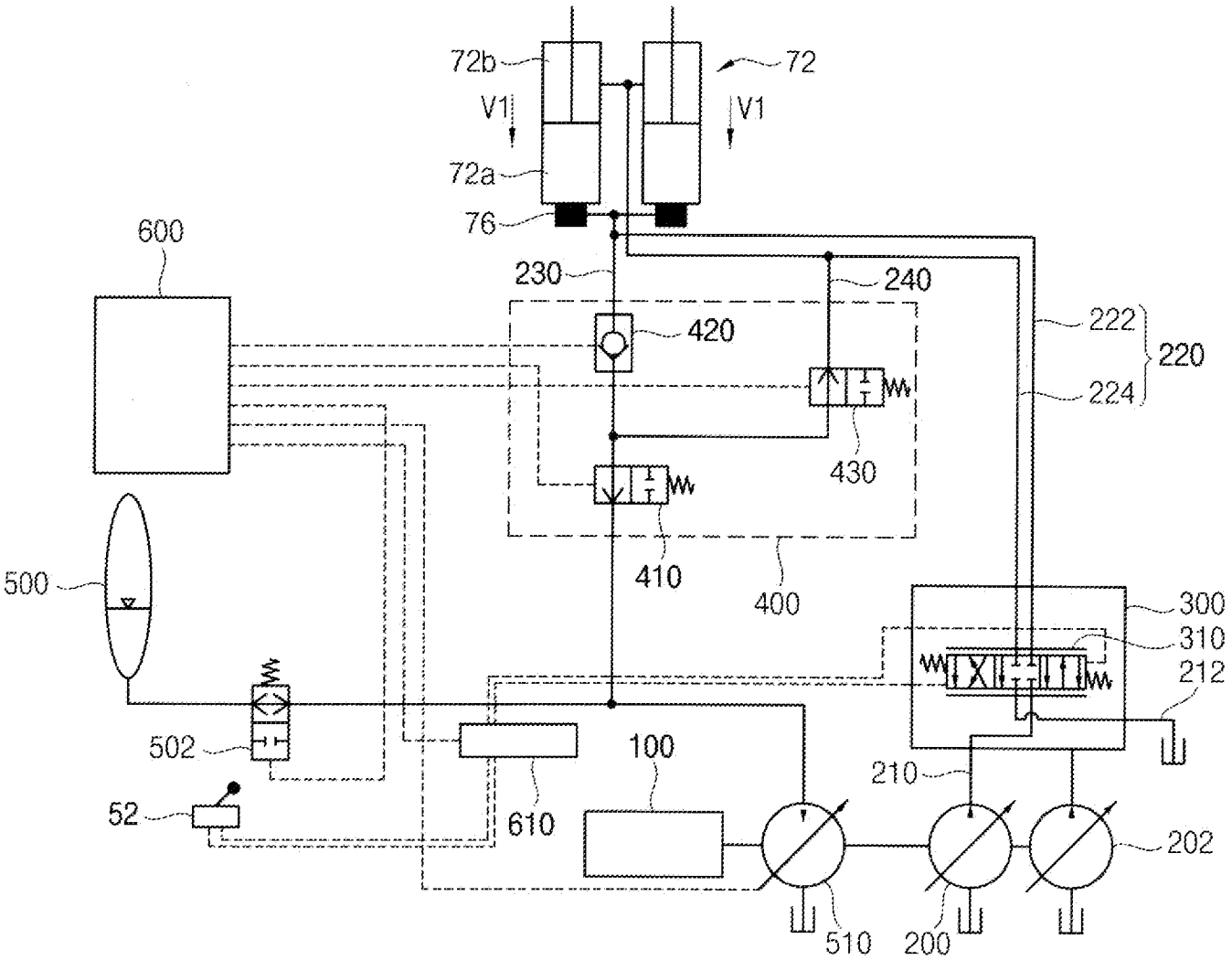
FIG. 3 is a hydraulic circuit diagram illustrating the hydraulic system in FIG. 2, when a boom down low speed mode is selected.
Figure 4:
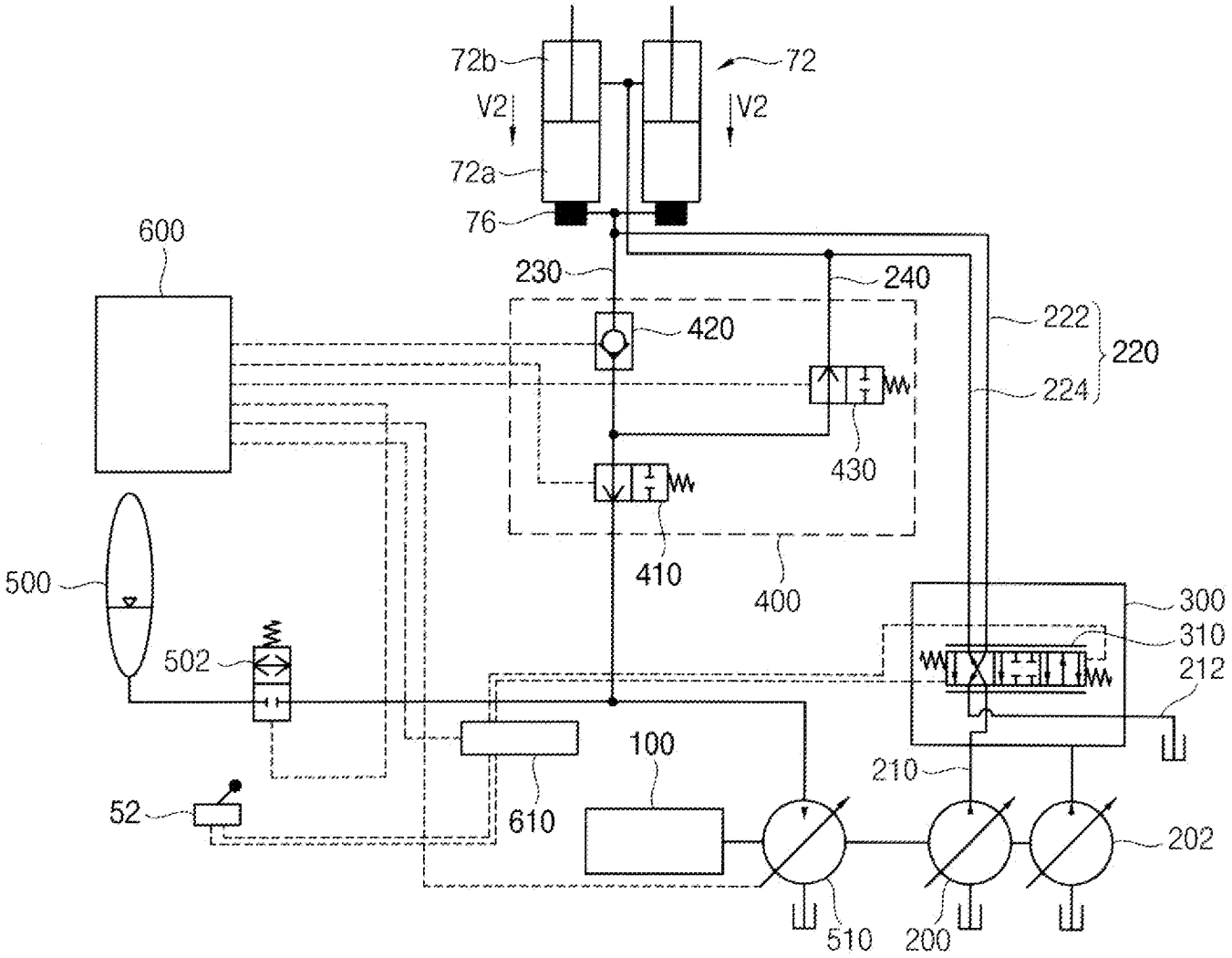
FIG. 4 is a hydraulic circuit diagram illustrating the hydraulic system in FIG. 2, when a boom down high speed mode is selected.

FIG. 1 is a side view illustrating construction machinery in accordance with example embodiments. FIG. 2 is a hydraulic circuit diagram illustrating a hydraulic system for construction machinery in accordance with example embodiments. FIG. 3 is a hydraulic circuit diagram illustrating the hydraulic system in FIG. 2, when a boom down low speed mode is selected. FIG. 4 is a hydraulic circuit diagram illustrating the hydraulic system in FIG. 2, when a boom down high speed mode is selected.

Referring to FIGS. 1 to 4, construction machinery 10 may include a lower travelling body 20, an upper swing body 30 mounted rotatably on the lower travelling body 20, and a cabin 50 and a front work apparatus 60 installed in the upper swing body 30.

The lower travelling body 20 may support the upper swing body 30, and may use a driving force generated by an engine 100 to travel the construction machinery 10 such as an excavator. The lower travelling body 20 may be a crawler type travelling body having a track shoe assembly. Alternatively, the lower travelling body 20 may be a wheel type travelling body including driving wheels. The upper swing body 30 may include an upper frame 32 as a base, and may rotate on a plane parallel with a ground to determine a working direction. The cabin 50 may be installed in a left front portion of the upper frame 32, and the front work apparatus 60 may be installed in a front body of the upper frame 32.

The front work apparatus 60 may include a boom 70, an arm 80 and a bucket 90. A boom cylinder 72 may be installed between the boom 70 and the upper frame 32 to control a movement of the boom 70. An arm cylinder 82 may be installed between the arm 80 and the boom 70 to control a movement of the arm 80. A bucket cylinder 92 may be installed between the bucket 90 and the arm 80 to control a movement of the bucket 90. As the boom cylinder 72, the arm cylinder 82 and the bucket cylinder 92 expand or contract, the boom 70, the arm 80 and the bucket 90 may implement various movements, so that the front work apparatus 60 may perform various works. The boom cylinder 72, the arm cylinder 82 and the bucket cylinder 92 may expand or contract by a hydraulic oil supplied from a hydraulic pump 200, 202 (not illustrated).

In addition, an energy regeneration system may be provided to regenerate boom energy which is wasted from the boom cylinder 72 when the boom 70 is lowered. The energy regeneration system may include a regeneration valve unit 400 having a plurality of valves.

The energy regeneration system may accumulate the hydraulic oil, which is discharged from the boom cylinder 72 when the boom 70 is lowered, in an accumulator 500 or supply the hydraulic oil to a hydraulic motor 510 to thereby assist an output of the engine, as described later.

As illustrated in FIG. 2, a hydraulic system of construction machinery in accordance with example embodiments, may include at least one hydraulic pump 200, 202 connected to the engine 100, at least one actuator 72, 82, 92 configured to operate the front work apparatus, a main control valve (MCV) 300 installed between the hydraulic pump and the actuator to control an operation of the actuator, a regeneration device configured to regenerate energy of the front work apparatus, and a control unit 600 configured to control an operation of the front work apparatus.

In example embodiments, the engine 100 may include a diesel engine as a driving source for a construction machine, for example, excavator. At least one hydraulic pump 200, 202 may be connected to the engine 100 through a power take off (PTO). Although it is not illustrated in the figures, a pilot pump or additional hydraulic pumps may be connected to the engine 100. Accordingly, a power of the engine 100 may be transferred to the hydraulic pump 200, 202 and the pilot pump.

The hydraulic pump 200, 202 may be connected to the main control valve 300 through a hydraulic line 210. The main control valve 300 may supply a hydraulic oil which is discharged from the hydraulic pump 200, 202, to the actuator such as the boom cylinder 72, arm cylinder 82, the bucket cylinder 92, etc.

The main control valve 300 may be connected to a plurality of actuators including the boom cylinder 72, the arm cylinder 82 and the bucket cylinder 92 through a high-pressure hydraulic line 220, respectively. Accordingly, the actuators such as the boom cylinder, the arm cylinder and the bucket cylinder may be driven by the hydraulic oil discharged from the hydraulic pump 200, 202.

For example, a boom control spool 310 may be connected to a boom head chamber 72*a* and a boom rod chamber 72*b* by a boom head hydraulic line 222 and a boom rod hydraulic line 224 respectively. Accordingly, the boom control spool 310 may be switched to selectively supply the hydraulic oil discharged from the hydraulic pump 200 to the boom head chamber 72*a* and the boom rod chamber 72*b*.

The hydraulic oil which drives the actuator may return to a drain tank T through a return hydraulic line 212. In example embodiments, when the boom is lowered, the hydraulic oil from the boom head chamber 72*a* may be drained to the drain tank T through the boom head hydraulic line 222 via the boom control spool 310. When the boom is raised, the hydraulic oil from the boom rod chamber 72*b* may be drained to the drain tank T through the boom rod hydraulic line 224 via the boom control spool 310.

In example embodiments, the hydraulic system for construction machinery may include the regeneration valve unit 400 which is installed in a hydraulic regeneration line 230 connected to the boom head chamber 72*a* to control a supply of the hydraulic oil to the regeneration device. The regeneration valve unit may include a discharge amount control valve 410, a check valve 420 and an auxiliary flow control valve 430. However, it may not be limited thereto, and the regeneration valve unit may have various valves adapted for the energy regeneration system.

The hydraulic regeneration line 230 may be connected to the boom head chamber 72*a*. A hydraulic line from a boom lock valve 76 may branch into the boom head hydraulic line 222 and the hydraulic regeneration line 230. The discharge amount control valve 410 may be installed in the hydraulic regeneration line 230 to control an amount of the hydraulic oil flowing through the hydraulic regeneration line 230. The check valve 420 for holding the boom 70 may be installed in the hydraulic regeneration line 230 in front of the discharge amount control valve 410 to selectively open and close the hydraulic regeneration line 230. An opening/closing valve 430 may be installed in a connection line 240 which connects the hydraulic regeneration line 230 to the boom rod chamber 72*b*, to selectively supply a portion of the hydraulic oil discharged through the hydraulic regeneration line 230 to the boom rod chamber 72*b* of the boom cylinder 72.

In example embodiments, the control unit 600 may output a pilot signal pressure to the regeneration valve unit to control supplying of the hydraulic oil to the regeneration device through the hydraulic regeneration line 230.

The control unit 600 may include a selection portion to select a control mode, a controller to apply an electrical signal, and first to third control valves to output a pilot signal pressure corresponding to the applied electrical signal.

In particular, the first control valve may apply a pilot signal pressure corresponding to an electrical signal applied from the controller, to the discharge amount control valve 410. The first control valve may include an electro proportional pressure reducing valve (EPPRV). The pilot signal pressure outputted from the first control valve may be supplied to a left port of the discharge amount control valve 410 to switch to the right direction in FIG. 2, to thereby open the hydraulic regeneration line 230. An opening area of the discharge amount control valve 410 through which the hydraulic oil passes may be changed according to a position of a control spool. Accordingly, the discharge amount control valve 410 may control opening/closing of the hydraulic regeneration line 230 or the amount of the hydraulic oil passing through the hydraulic regeneration line 230.

The second control valve may apply a pilot signal pressure corresponding to an electrical signal applied from the controller, to the check valve 420. The first control valve may include an electro proportional pressure reducing valve (EPPRV). The pilot signal pressure outputted from the second control valve may be supplied to the check valve 420 to open the hydraulic regeneration line 230. The check valve 420 may be a pilot-operated check valve which is held open by the pilot signal pressure.

The third control valve may apply a pilot signal pressure corresponding to an electrical signal applied from the controller, to the opening/closing valve 430. The third control valve may include an electro proportional pressure reducing valve (EPPRV). The pilot signal pressure outputted from the third control valve may be supplied to a left port of the opening/closing valve 430 to switch to the right direction in FIG. 2, to thereby open the connection line 240. Thus, as the boom rod chamber 72*b* is connected to the hydraulic regeneration line 230 through the connection line 240, insufficient flow rates due to an area difference between the head side and the rod side of the boom cylinder when the boom is lowered, may be supplied to the boom rod chamber 72*b* of the boom cylinder 72.

In example embodiments, the regeneration device may regenerate energy using the high-pressure hydraulic oil discharged from the boom head chamber 72*a* of the boom cylinder 72. The regeneration device may include an accumulator 500 and a hydraulic motor 510. A distal end of the hydraulic regeneration line 230 may branch to be connected to the accumulator 500 and the hydraulic motor 510.

The accumulator 500 may accumulate the high-pressure hydraulic oil which is discharged from the boom head chamber 72*a* of the boom cylinder 72 when the boom is lowered. An opening/closing valve 502 may be installed in the hydraulic regeneration line 230 connected to the accumulator 500 to control supplying/discharging of the hydraulic oil to/from the accumulator 500.

In particular, the control unit may include a fourth control valve to output a pilot signal pressure corresponding to an applied electrical signal, and the fourth control valve may output the pilot signal pressure to the opening/closing valve 502. The fourth control valve may include an electro proportional pressure reducing valve (EPPRV). The opening/closing valve 502 may be switched by the pilot signal pressure outputted from the fourth control valve, to control supplying/discharging of the hydraulic oil to/from the accumulator 500.

The hydraulic motor 510 may be connected to a drive axis of the engine 100 to assist driving power of the engine. The hydraulic motor 510 may be connected to the drive axis of the engine 100 through the power take off (PTO) having a predetermined gear ratio.

In example embodiments, the main control valve 300 may include a hydraulic type control valve. The boom control spool 310 may be controlled by a pilot pressure in proportion to a manipulation signal of a manipulation portion 52.

In particular, as an operator manipulates the manipulating portion 52, the manipulation portion 52 may generate a pilot oil, which is discharged from the pilot pump, to have the pilot pressure in proportion to the manipulation signal and may supply the pilot oil to the boom control spool 310 through control lines. Accordingly, the boom control spool 310 may be displaced in proportion to the pilot pressure of the pilot oil, and thus, the hydraulic oil discharge from the hydraulic pump 200 may be supplied to the boom cylinder through the boom control spool 310.

The control unit may include a bypass valve 610 which is provided in the control lines between the manipulation portion 52 and the main control valve 300 to block the control pressure (pilot pressure) from being transferred to the main control valve 300. The bypass valve 610 may include an opening/closing valve.

In this case, the control unit may include a fifth control valve to output a pilot signal pressure corresponding to an applied electrical signal, and the fifth control valve may output the pilot signal pressure to the bypass valve 610. The fifth control valve may include an electro proportional pressure reducing valve (EPPRV). The bypass valve 502 may be switched by the pilot signal pressure outputted from the fifth control valve to open and close the control lines, and thus, the pilot pressure from the manipulation portion 52 may be selectively blocked from being transferred to the boom control spool 310.

The selection portion of the control unit may output a selection signal according to a selection of an operator or a control mode determined by control logic, to the controller. The selection portion may select any one of a boom down low speed mode and a boom down high speed mode and output the selected control mode to the controller.

For example, the selection portion may determine the control mode through information inputted by a user interface such as a selection switch. Alternatively, the selection portion including the control logic may calculate manipulation pattern information of an operator to automatically determine the control mode.

As illustrated in FIG. 3, when an operator selects the boom down low speed mode as the control mode and inputs a boom down signal with the manipulation portion 52, the control unit may apply a pilot signal pressure corresponding to the boom down low speed mode to the discharge amount control valve 410, the check valve 420 and the opening/ closing valve 430 to open the hydraulic regeneration line 230. Additionally, the control unit may apply a pilot signal pressure to the bypass valve 610 such that a pilot pressure from the manipulation portion 52 may be blocked from being transferred to the boom control spool 310 of the main control valve 300.

Accordingly, in the boom down low speed mode, the hydraulic oil from the boom head chamber 72*a* of the boom cylinder 72 may be supplied to the regeneration device through the hydraulic regeneration line 230 to thereby regenerate potential energy of the boom. On the other hand, because the pilot pressure is not supplied to the boom control spool 310 of the main control valve 300, the boom control spool 310 may not be switched by the boom down signal of the manipulation portion 52 and the hydraulic oil from the boom head chamber 72*a* may not flow through the boom head hydraulic line 222. Thus, in the boom down low speed mode, the hydraulic oil discharged from the boom cylinder 72 may be drained to the drain tank T through the hydraulic motor 510 of the regeneration device.

As illustrated in FIG. 4, when an operator selects the boom down high speed mode as the control mode and inputs a boom down signal with the manipulation portion 52, the control unit may apply a pilot signal pressure corresponding to the boom down high speed mode to the discharge amount control valve 410, the check valve 420 and the opening/closing valve 430 to open the hydraulic regeneration line 230. Additionally, the control unit may open the bypass valve 610 such that a pilot pressure from the manipulation portion 52 may be transferred to the boom control spool 310 of the main control valve 300. Here, the control unit may apply a pilot signal pressure to the opening/closing valve 502 of the accumulator 500 to block the hydraulic oil from being supplied to the accumulator 500.

Accordingly, in the boom down high speed mode, the hydraulic oil from the boom head chamber 72*a* of the boom cylinder 72 may be supplied to the regeneration device through the hydraulic regeneration line 230 and may be supplied to the boom control spool 310 of the main control valve 300 through the boom head hydraulic line 222, to thereby regenerate potential energy of the boom. In the boom down high speed mode, the hydraulic oil discharged from the boom cylinder 72 may be drained to the drain tank T through the hydraulic motor 510 of the regeneration device and may be drained to the drain tank T through the main control valve 300.

When the hydraulic oil is discharged from the boom cylinder 72 by gravity of the front work apparatus, an opening area through which the hydraulic oil passes to be drained in the boom down high speed mode may be greater than that in the boom down low speed mode. Accordingly, the boom 70 may be lowered at a first speed (V1) in the boom down low speed mode, and the boom 70 may be lowered at a second speed (V2) greater than the first speed (V1) in the boom down high speed mode. Accordingly, in the boom down high speed mode, a work rate of the boom 70 may be increased more relatively.

As mentioned above, in the hydraulic system of construction machinery, when the boom is lowered, boom energy may be recovered to reduce fuel consumption to thereby improve fuel efficiency. Further, as the boom descent speed is increased, a work rate of the boom 70 may be increased to improve productivity. Especially, in a work (for example, a loading work) in which the construction machinery performs a boom up operation and a boom down operation repeatedly, productivity may be maximized.

On the other hand, when an operator selects a boom down normal mode as the control mode and inputs a boom down signal, the control unit may close the hydraulic regeneration line 230 such that the hydraulic oil may be blocked from being supplied to the regeneration device through the hydraulic regeneration line 230. Additionally, the control unit may open the bypass valve 610 such that the pilot pressure from the manipulation portion 52 may be transferred to the boom control spool 310 of the main control valve 300.

Accordingly, in the boom down normal mode, the hydraulic oil from the boom head chamber 72*a* of the boom cylinder 72 may be supplied to the boom control spool 310 of the main control valve 300. In the boom down normal mode, the hydraulic oil discharged from the boom cylinder 72 may be drained to the drain tank T through the main control valve 300. On the other hand, the hydraulic regeneration line 230 may be closed such that the hydraulic oil from the boom head chamber 72*a* may not be supplied to the regeneration device.

Figure 5:
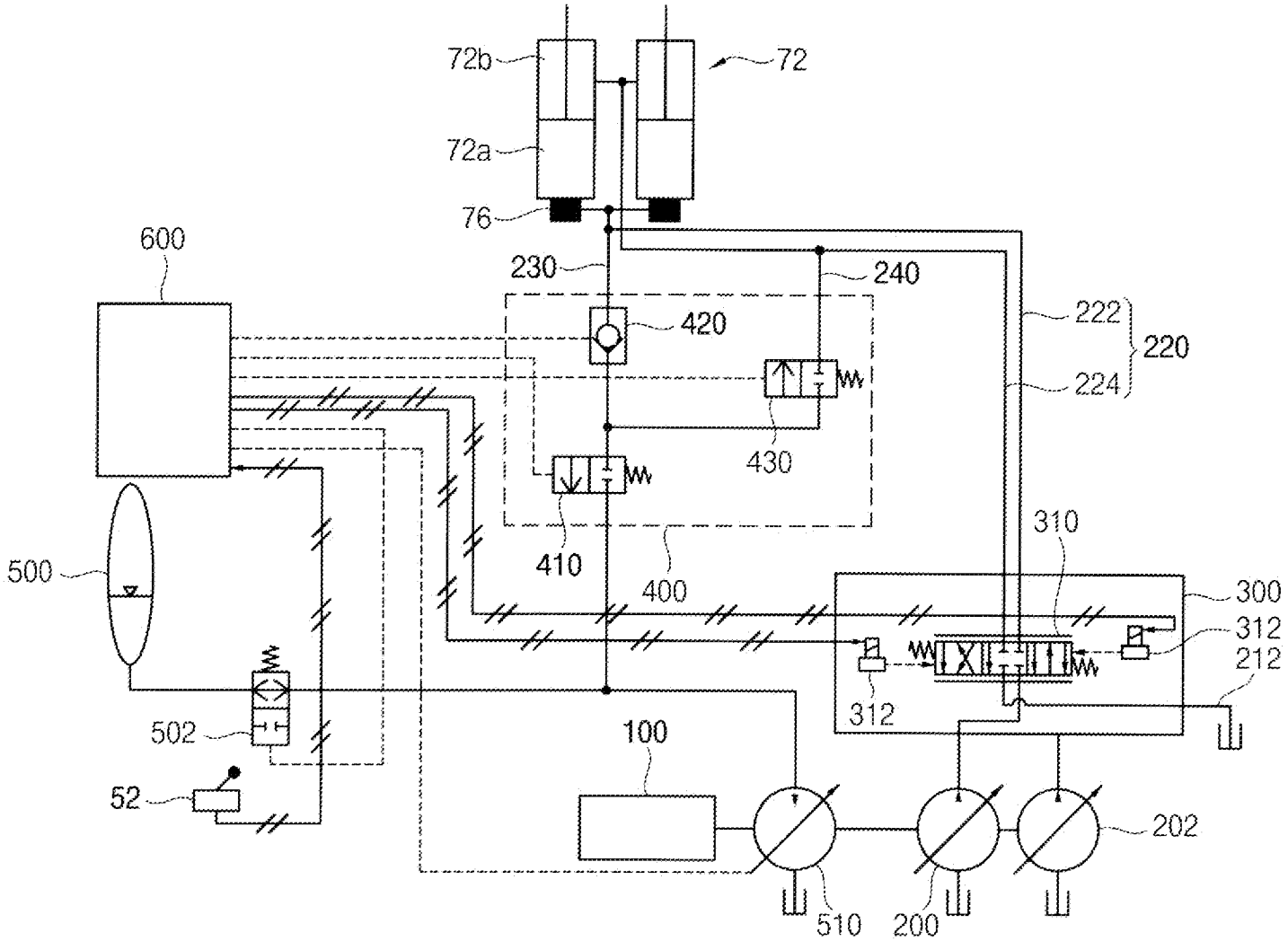
FIG. 5 is a hydraulic circuit diagram illustrating a hydraulic system for construction machinery in accordance with example embodiments.
Figure 6:
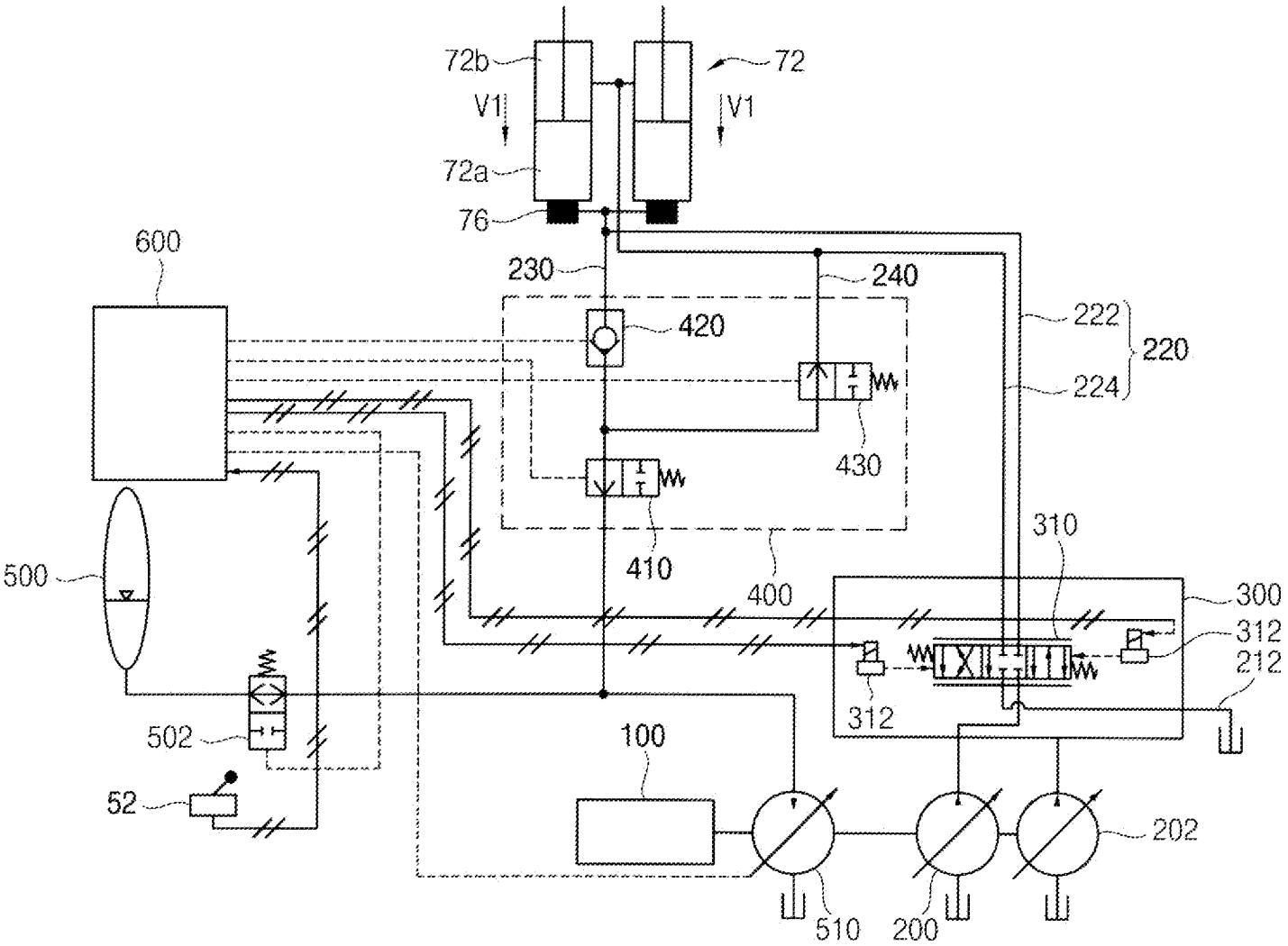
FIG. 6 is a hydraulic circuit diagram illustrating the hydraulic system in FIG. 5, when a boom down low speed mode is selected.
Figure 7:
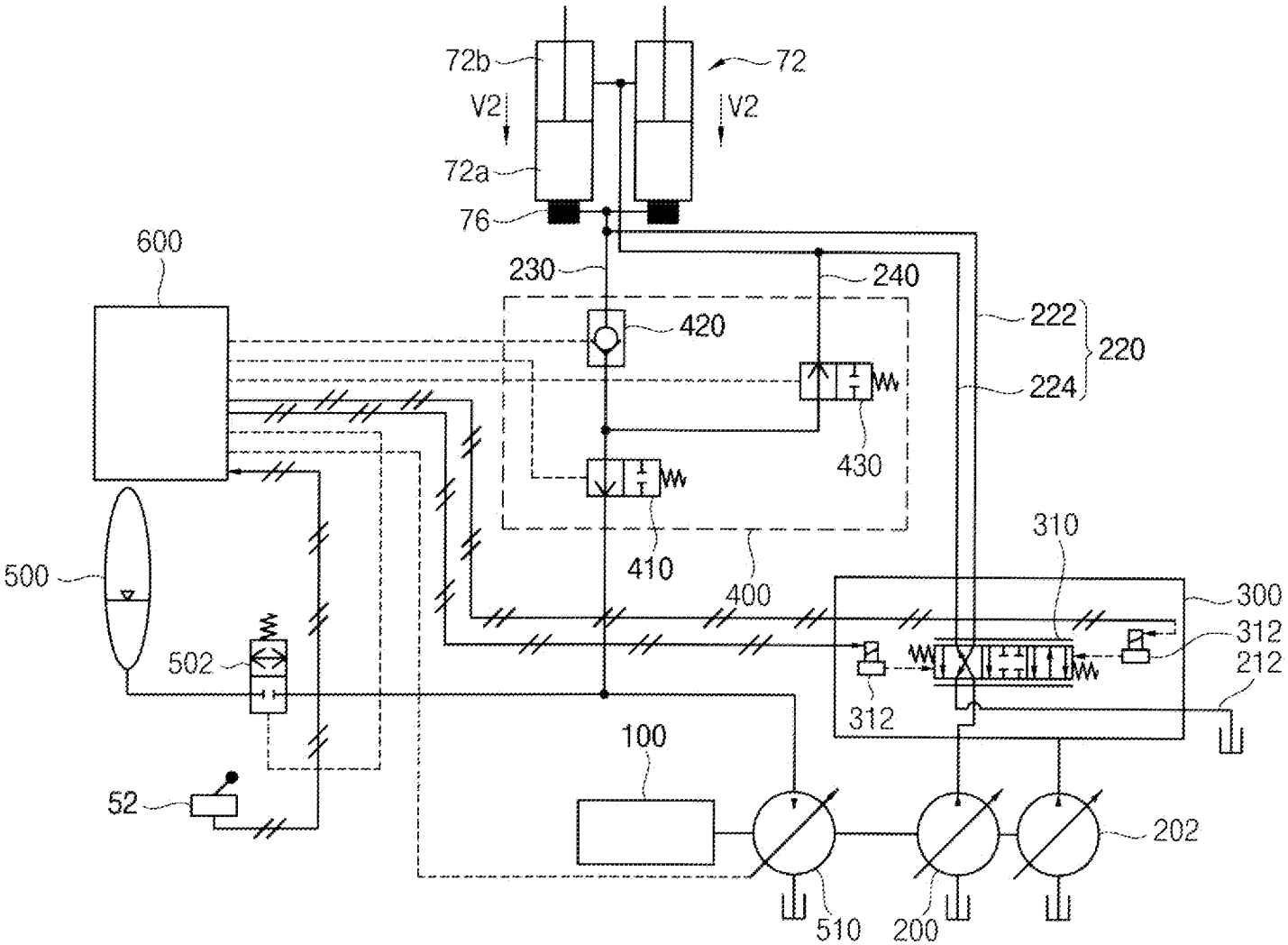
FIG. 7 is a hydraulic circuit diagram illustrating the hydraulic system in FIG. 5, when a boom down high speed mode is selected.

FIG. 5 is a hydraulic circuit diagram illustrating a hydraulic system for construction machinery in accordance with example embodiments. FIG. 6 is a hydraulic circuit diagram illustrating the hydraulic system in FIG. 5, when a boom down low speed mode is selected. FIG. 7 is a hydraulic circuit diagram illustrating the hydraulic system in FIG. 5, when a boom down high speed mode is selected. The hydraulic system for construction machinery may be substantially the same as or similar to the hydraulic system for construction machinery as described with reference to FIGS. 2 to 4, except that the hydraulic system includes an electro-hydraulic control valve. Thus, same reference numerals will be used to refer to the same or like elements and any further repetitive explanation concerning the above elements will be omitted.

Referring to FIGS. 5 to 7, in example embodiments, a main control valve 300 may include an electro-hydraulic control valve. A boom control spool 310 may be controlled by electro proportional pressure reducing valves (EPPRVs) 312 which output a secondary pressure (pilot pressure) in proportion to an external pressure command signal (control current signal).

In particular, a control unit may receive an electrical signal in proportion to a manipulation amount of an operator from a manipulation portion 52, and may output the pressure command signal (control current signal) to the electro proportional pressure reducing valves 312 corresponding to the electrical signal. The electro proportional pressure reducing valves 312 may output the secondary pressure in proportion to the pressure command signal to the boom control spool 310 to control the boom control spool with the electrical signal.

A pair of the electro proportional pressure reducing valves 312 may be provided in both sides of the boom control spool 310. The electro proportional pressure reducing valve may supply a secondary pressure in proportion to the pressure command signal to the boom control spool such that the boom control spool may be displaced in proportion to the secondary pressure. Thus, a hydraulic oil from a hydraulic pump 200 may be supplied to a boom cylinder 72 through the boom control spool 310.

The control unit may include a controller to apply a pressure command signal (for example, control current signal) as an electrical signal to the electro proportional pressure reducing valves 312 of the main control valve 300. The controller may selectively apply the pressure command signal corresponding to the electrical signal applied from the manipulation portion 52, to the electro proportional pressure reducing valves 312 of the main control valve 300. For example, the controller may not apply the pressure command signal to the electro proportional pressure reducing valves 312 according to a selected control mode, such that a control pressure (pilot pressure) from the manipulation portion 52 may be blocked from being transferred to the main control valve 300.

As illustrated in FIG. 6, when an operator selects the boom down low speed mode as a control mode and inputs a boom down signal with the manipulation portion 52, the control unit may apply a pilot signal pressure corresponding to the selected control mode to the discharge amount control valve 410, the check valve 420 and the opening/closing valve 430 to open the hydraulic regeneration line 230. Additionally, the control unit may not apply the pressure command signal to the electro proportional pressure reducing valves 312 such that a pilot pressure from the manipulation portion 52 may be blocked from being transferred to the boom control spool 310 of the main control valve 300.

Accordingly, in the boom down low speed mode, the hydraulic oil from the boom head chamber 72*a* of the boom cylinder 72 may be supplied to the regeneration device through the hydraulic regeneration line 230 to thereby regenerate potential energy of the boom. On the other hand, because the boom control spool 310 of the main control valve 300 does not operate, the hydraulic oil from the boom head chamber 72*a* may not flow through the boom head hydraulic line 222. In the boom down low speed mode, the hydraulic oil discharged from the boom cylinder 72 may be drained to the drain tank T through a hydraulic motor of the regeneration device.

As illustrated in FIG. 7, when an operator selects the boom down high speed mode as the control mode and inputs a boom down signal with the manipulation portion 52, the control unit may apply a pilot signal pressure corresponding to the selected control mode to the discharge amount control valve 410, the check valve 420 and the opening/closing valve 430 to open the hydraulic regeneration line 230. Additionally, the control unit may apply the pressure command signal to the electro proportional pressure reducing valves 312 such that a pilot pressure from the manipulation portion 52 may be transferred to the boom control spool 310 of the main control valve 300. Here, the control unit may apply a pilot signal pressure to the opening/closing valve 502 of the accumulator 500 to block the hydraulic oil from being supplied to the accumulator 500.

Accordingly, in the boom down high speed mode, the hydraulic oil from the boom head chamber 72*a* of the boom cylinder 72 may be supplied to the regeneration device through the hydraulic regeneration line 230 and may be supplied to the boom control spool 310 of the main control valve 300 through the boom head hydraulic line 222, to thereby regenerate potential energy of the boom. In the boom down high speed mode, the hydraulic oil discharged from the boom cylinder 72 may be drained to the drain tank T through the hydraulic motor 510 of the regeneration device and may be drained to the drain tank T through the main control valve 300.

When the hydraulic oil is discharged from the boom cylinder 72 by gravity of the front work apparatus, in the boom down low speed mode the hydraulic oil may be drained through the regeneration device and in the boom down high speed mode the hydraulic oil may be drained through the regeneration device and the main control valve. Accordingly, an opening area through which the hydraulic oil passes to be drained in the boom down high speed mode may be greater than that in the boom down low speed mode. Therefore, the boom 70 may be lowered at a first speed (V1) in the boom down low speed mode, and the boom 70 may be lowered at a second speed (V2) greater than the first speed (V1) in the boom down high speed mode.

Hereinafter, a hydraulic control method for construction machinery using the hydraulic system in FIGS. 2 and 5 will be explained.

Figure 8:
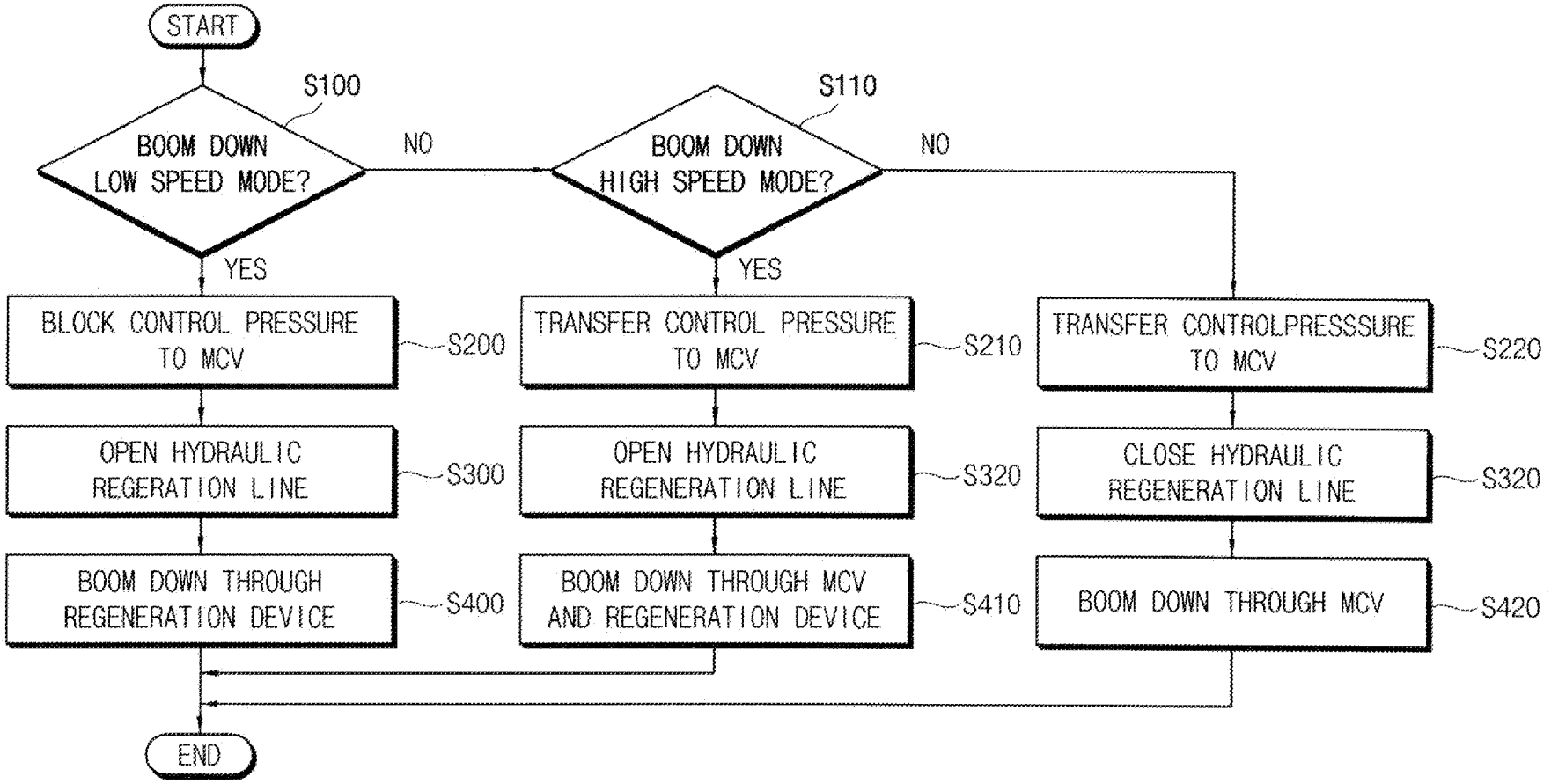
FIG. 8 is a flow chart illustrating a hydraulic control method of construction machinery in accordance with example embodiments.

FIG. 8 is a flow chart illustrating a hydraulic control method of construction machinery in accordance with example embodiments.

Referring to FIGS. 2, 5 and 8, any one of a boom down low speed mode and a boom down high speed mode may be selected as a regeneration mode in order to regenerate boom energy of construction machinery (S100, S110).

In example embodiments, a control mode may be determined by a selection of an operator or control logic. The control mode may include a boom down normal mode, the boom down low speed mode and the boom down high speed mode.

For example, the control mode may be determined based on information inputted by an operator through a user interface such as a selection switch. Alternatively, a control unit may include the control logic which calculates manipulation pattern information of an operator to automatically determine the control mode.

Then, a control pressure from a manipulation portion 52 may be selectively transferred to a main control valve 300 according to the selected control mode to selectively open and close a hydraulic regeneration line 230.

In example embodiments, in a case that the boom down low speed mode is selected, when an operator inputs a boom down signal with the manipulation portion 52, a control pressure from the manipulation portion 52 may be blocked from being transferred to a boom control spool 310 of a main control valve 300 (S200), and a discharge amount control valve 410, a check valve 420 and an opening/closing valve 430 may be switched to open the hydraulic regeneration line 230 (S300). Then, a boom 72 may be lowered while a hydraulic oil from a boom cylinder 72 is supplied to a regeneration device connected to the hydraulic regeneration line 230 (S400).

In the boom down low speed mode, the hydraulic oil from a boom head chamber 72*a* of the boom cylinder 72 may be supplied to the regeneration device through the hydraulic regeneration line 230 to thereby regenerate potential energy of the boom. On the other hand, because the boom control spool 310 of the main control valve 300 does not operate, the hydraulic oil from the boom head chamber 72*a* may not flow through a boom head hydraulic line 222. In the boom down low speed mode, the hydraulic oil discharged from the boom cylinder 72 may be drained to the drain tank through a hydraulic motor of the regeneration device.

In example embodiments, in a case that the boom down high speed mode is selected, when an operator inputs a boom down signal with the manipulation portion 52, a control pressure from the manipulation portion 52 may be transferred to the boom control spool 310 of the main control valve 300 (S210), and the discharge amount control valve 410, the check valve 420 and the opening/closing valve 430 may be switched to open the hydraulic regeneration line 230 (S310). Then, the boom 72 may be lowered while the hydraulic oil from the boom cylinder 72 is supplied to the regeneration device connected to the hydraulic regeneration line 230 and is supplied to the main control valve 330 connected to the boom head hydraulic line 222 (S410).

In the boom down high speed mode, the hydraulic oil from the boom head chamber 72*a* of the boom cylinder 72 may be supplied to the regeneration device through the hydraulic regeneration line 230 and may be supplied to the boom control spool 310 of the main control valve 300 through the boom head hydraulic line 222 to thereby regenerate potential energy of the boom. In the boom down high speed mode, the hydraulic oil discharged from the boom cylinder 72 may be drained to the drain tank T through the hydraulic motor of the regeneration device and the main control valve 300.

When the hydraulic oil is discharged from the boom cylinder 72 by gravity of a front work apparatus, an opening area through which the hydraulic oil passes to be drained in the boom down high speed mode may be greater than that in the boom down low speed mode. Accordingly, the boom 70 may be lowered at a first speed (V1) in the boom down low speed mode, and the boom 70 may be lowered at a second speed (V2) greater than the first speed (V1) in the boom down high speed mode.

In example embodiments, in a case that the boom down normal mode is selected, when an operator inputs a boom down signal with the manipulation portion 52, a control pressure from the manipulation portion 52 may be transferred to the boom control spool 310 of the main control valve 300 (S220), and the discharge amount control valve 410, the check valve 420 and the opening/closing valve 430 may be switched to close the hydraulic regeneration line 230 (S320). Then, the boom 72 may be lowered while the hydraulic oil from the boom cylinder 72 is supplied to the main control valve 330 connected to the boom head hydraulic line 222 (S420).

Accordingly, in the boom down normal mode, the hydraulic oil from the boom head chamber 72*a* of the boom cylinder may be supplied to the boom control spool 310 of the main control valve 300 through the boom head hydraulic line 222. In the boom down normal mode, the hydraulic oil discharged from the boom cylinder 72 may be drained to the drain tank T through the main control valve 300. On the other hand, the hydraulic regeneration line 230 may be closed such that the hydraulic oil from the boom head chamber 72*a* may not be supplied to the regeneration device.

The present invention has been explained with reference to preferable embodiments, however, those skilled in the art may understand that the present invention may be modified or changed without being deviated from the concept and the scope of the present invention disclosed in the following claims.

<The description of the reference numerals>

| | |
|---|---|
| 10: construction machinery | 20: lower travelling body |
| 30: upper swing body | 32: upper frame |
| 40: counter weight | 50: cabin |
| 52: manipulation portion | 60: work apparatus |
| 70: boom | 72: boom cylinder |
| 72a: boom head chamber | 72b: boom rod chamber |
| 76: boom lock valve | 80: arm |
| 82: arm cylinder | 90: bucket |
| 92: bucket cylinder | 100: engine |
| 200, 202: hydraulic pump | 210: hydraulic line |
| 212: return hydraulic line | 220: high-pressure hydraulic line |
| 222: boom head hydraulic line | 224: boom rod hydraulic line |
| 230: hydraulic regeneration line | 300: main control valve |
| 310: boom control spool | 312: electro proportional pressure reducing valve |
| 400: regeneration valve unit | 410: discharge amount control valve |
| 420: check valve | 430: opening/closing valve |
| 500: accumulator | 502: opening/closing valve |

-continued

<The description of the reference numerals>

| | |
|---|---|
| 510: hydraulic motor | 600: control unit |
| 610: bypass valve | |

The invention claimed is:

1. A hydraulic system for construction machinery, comprising:

a boom cylinder configured to operate a boom of the construction machinery;

a main control valve including a boom control spool configured to selectively supply a hydraulic oil from a hydraulic pump to a boom head chamber through a boom head hydraulic line and a boom rod chamber of the boom cylinder through a boom rod hydraulic line;

a regeneration device connected to the boom head chamber of the boom cylinder through a hydraulic regeneration line to regenerate energy of the boom cylinder;

a regeneration valve unit installed in the hydraulic regeneration line and including a discharge amount control valve configured to control an amount of the hydraulic oil flowing through the hydraulic regeneration line;

a control unit connected to the main control valve and the regeneration valve unit and configured to control operations of the main control valve and the regeneration valve unit; and a bypass valve provided between a manipulation portion for manipulating the boom and the main control valve and configured to block a control pressure from the manipulation portion from being transferred to the main control valve, wherein, in a boom down low speed mode, the hydraulic oil is drained through the regeneration device to lower the boom at a first speed, and in a boom down high speed mode, the hydraulic oil is drained through the regeneration device and the main control valve to lower the boom at a second speed greater than the first speed.

2. The hydraulic system for construction machinery of claim 1, wherein the regeneration valve unit further comprises a check valve installed in the hydraulic regeneration line between the boom head chamber and the discharge amount control valve.

3. The hydraulic system for construction machinery of claim 1, wherein the regeneration valve unit further comprises an opening/closing valve installed in a connection line which connects the hydraulic regeneration line to the boom rod chamber and configured to selectively supply a portion of the hydraulic oil discharged through the hydraulic regeneration line to the boom rod chamber.

4. The hydraulic system for construction machinery of claim 1, wherein the regeneration device comprises a hydraulic motor connected to the hydraulic regeneration line and the hydraulic motor is connected to a drive axis of an engine to provide a rotational force to the hydraulic pump.

5. The hydraulic system for construction machinery of claim 4, wherein the regeneration device further comprises an accumulator connected to the hydraulic regeneration line.

6. The hydraulic system for construction machinery of claim 5, further comprising:

an opening/closing valve installed in the hydraulic regeneration line connected to the accumulator and configured to selectively supply the hydraulic oil to the accumulator.

7. A hydraulic system for construction machinery, comprising:

a boom cylinder configured to operate a boom of the construction machinery;

a main control valve including a boom control spool configured to selectively supply a hydraulic oil from a hydraulic pump to a boom head chamber through a boom head hydraulic line and a boom rod chamber of the boom cylinder through a boom rod hydraulic line;

a regeneration device connected to the boom head chamber of the boom cylinder through a hydraulic regeneration line to regenerate energy of the boom cylinder;

a regeneration valve unit installed in the hydraulic regeneration line and including a discharge amount control valve configured to control an amount of the hydraulic oil flowing through the hydraulic regeneration line; and a control unit connected to the main control valve and the regeneration valve unit and configured to control operations of the main control valve and the regeneration valve unit wherein, in a boom down low speed mode, the hydraulic oil is drained through the regeneration device to lower the boom at a first speed, and in a boom down high speed mode, the hydraulic oil is drained through the regeneration device and the main control valve to lower the boom at a second speed greater than the first speed, and wherein the control unit controls such that, in the boom down low speed mode, the discharge amount control valve is opened and a control pressure from a manipulation portion is blocked from being transferred to the boom control spool.

8. The hydraulic system for construction machinery of claim 7, wherein the control unit controls such that, in the boom down high speed mode, the discharge amount control valve is opened and a control pressure from a manipulation portion is transferred to the boom control spool.

9. The hydraulic system for construction machinery of claim 8, wherein the hydraulic oil from the boom head chamber is drained to a drain tank through the boom head hydraulic line and the boom control spool.

* * * * *